US006651841B2

(12) United States Patent
Tsuchida

(10) Patent No.: US 6,651,841 B2
(45) Date of Patent: Nov. 25, 2003

(54) MACHINE FOR DISPENSING STACKED ARTICLES

(75) Inventor: Tamotsu Tsuchida, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 126 days.

(21) Appl. No.: 09/873,578

(22) Filed: Jun. 4, 2001

(65) Prior Publication Data

US 2002/0000447 A1 Jan. 3, 2002

(30) Foreign Application Priority Data

Jun. 5, 2000 (JP) ..... 2000-168094

(51) Int. Cl.[7] ..... B65H 59/06
(52) U.S. Cl. ..... 221/251; 221/270; 271/166
(58) Field of Search ..... 221/270, 275, 221/251; 414/797.5; 271/166

(56) References Cited

U.S. PATENT DOCUMENTS 730,920 A * 6/1903 Joecken ..... 144/245.5
3,075,671 A * 1/1963 McAlpine et al. ..... 221/238
3,206,066 A * 9/1965 MCalpine et al. ..... 221/242
3,752,361 A * 8/1973 VanLinder et al. ..... 221/251
3,765,546 A * 10/1973 Westerling ..... 414/795.2
3,858,732 A * 1/1975 Kemper ..... 414/797.5
3,933,255 A * 1/1976 Lieder et al. ..... 414/795.7
4,331,260 A * 5/1982 Euteneuer et al. ..... 221/19
4,702,660 A * 10/1987 Niehaus et al. ..... 414/795.2
5,476,191 A * 12/1995 Dunford et al. ..... 221/218
5,755,551 A * 5/1998 Saeki et al. ..... 414/797.6

FOREIGN PATENT DOCUMENTS

JP 5081535 4/1993

* cited by examiner

*Primary Examiner*—Donald P. Walsh
*Assistant Examiner*—J Rodriguez

(57) ABSTRACT

The present invention is a machine for dispensing articles, such as a vending machine, wherein the bottom article in a stack of articles is dispensed. To solve the problem of frictional resistance and excessive weight on the bottom article as it is being dispensed, the present invention provides a lifting mechanism to raise a portion of the stack of articles while the machine dispenses the bottom article. The lifting of the stack of articles above the bottom article relieves the weight of the stack from the bottom article, thereby reducing the frictional force as the machine slides the article out of a gate. In a preferred embodiment, a pair of lifting mechanisms operated by a common driving source cooperate to lift the portion of the stack of articles during the sliding operation and return the stack automatically once the bottom article has been dispensed.

4 Claims, 10 Drawing Sheets

MACHINE FOR DISPENSING STACKED ARTICLES

BACKGROUND OF THE INVENTION

1. Field of the Invention

The present invention relates generally to an automatic dispensing machine such as, for example, a vending machine, and more particularly to a dispensing machine that dispenses the lowermost article from a stack of articles stored in the machine.

2. Description of the Related Art

In some vending machines, it is a common practice to store the merchandise in a vertical column or stack one on top of the other. When a particular article is to be dispensed from the stack, a pusher mechanism moves the lowermost article from beneath the stack towards a dispensing port. If the articles are short and wide, like for example a compact disc cassette, the number of stacked articles on the lowermost article may be significantly high. The difficulty arises when the height of the stack of merchandise is such that the weight produces substantial friction forces between the lowermost article being dispensed and the surface on which it slides. This phenomena can cause both damage to the article during the dispensing process, as well as jamming of the machine.

SUMMARY OF THE INVENTION

The present invention includes a carrier that transports a stack of articles to a dispensing station. At the dispensing station, a portion of the stack of articles is lifted by a lifting mechanism that reduces the weight on the lowermost article to be dispensed. The lowermost article in the stack is then dispensed without the undue frictional load that otherwise would accompany the dispensing of the article if the full stack weight was resting on the lowermost article. In a preferred embodiment of the present invention, a pair of lift mechanisms cooperates to lift a portion of the stack of articles prior to the dispensing of the lowermost article. In the preferred embodiment, a pair of linkages driven by a single driving sources achieves the lifting function. The use of a single driving source removes the need for synchronization of multiple driving sources, resulting in a simpler operation. A sensor may be used to signal the disbursement of the article from the automated article dispenser, and the signal may be used as a trigger to return the lifting mechanism to an idle condition. In other words, once the sensor determines that the article has been dispensed from the machine, the lifting mechanism lowers the stack of articles until the time for another article to be dispensed, and the stack of merchandise is returned to a stored position.

BRIEF DESCRIPTION OF THE DRAWINGS

The exact nature of this invention, as well as its objects and advantages, will become readily apparent upon reference to the following detailed description when considered in conjunction with the accompanied drawings in which like reference numerals designate like parts throughout the figures thereof, and wherein.

DETAILED DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the general principles of the present invention have been defined herein specifically to provide a machine for dispensing articles from a stack.

Figure 1:
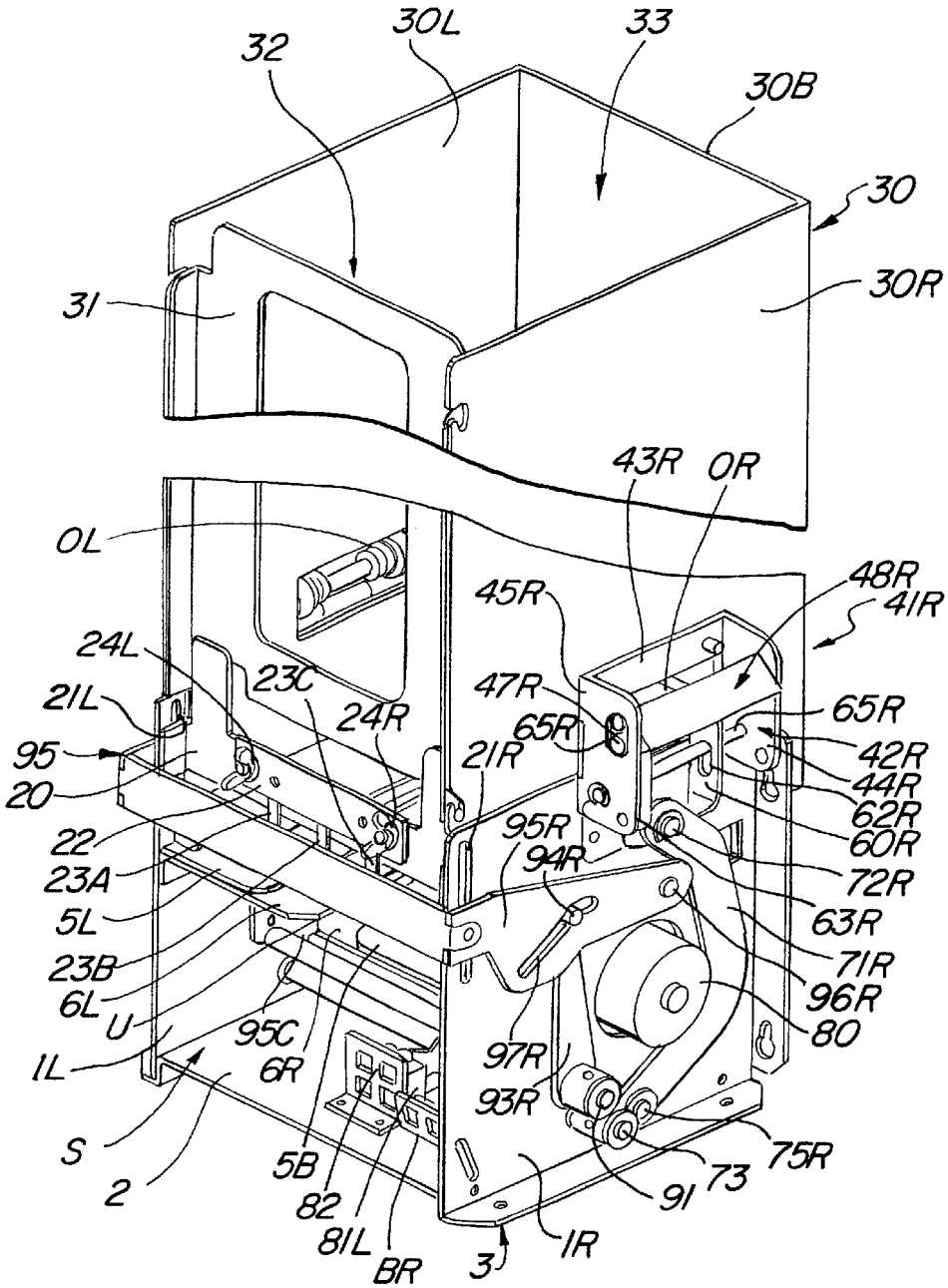
FIG. 1 is an elevated perspective view of a preferred embodiment of the present invention.

Turning to FIG. 1, an elevated perspective view of an automated article dispensing machine is shown. A rectangular U-shaped base is constructed of side plates 1R, 1L, and base plate 2, defining a space S. Projecting towards the interior of the base along the upper portions of side plates 1R and 1L are a pair of platforms 4R, 4L oriented substantially horizontal. The platforms 4L and 4R form a portion of the loading station D. There is a gap between the ends of the platforms 4L and 4R, and a pushing mechanism 14 reciprocates in the gap to dispense the lowermost article in a stack of articles on the loading station D. Just below the platforms 4L, 4R are a pair of guide plates 5L, 5R, each affixed to their respective side plates 1L, 1R.

Figure 2:
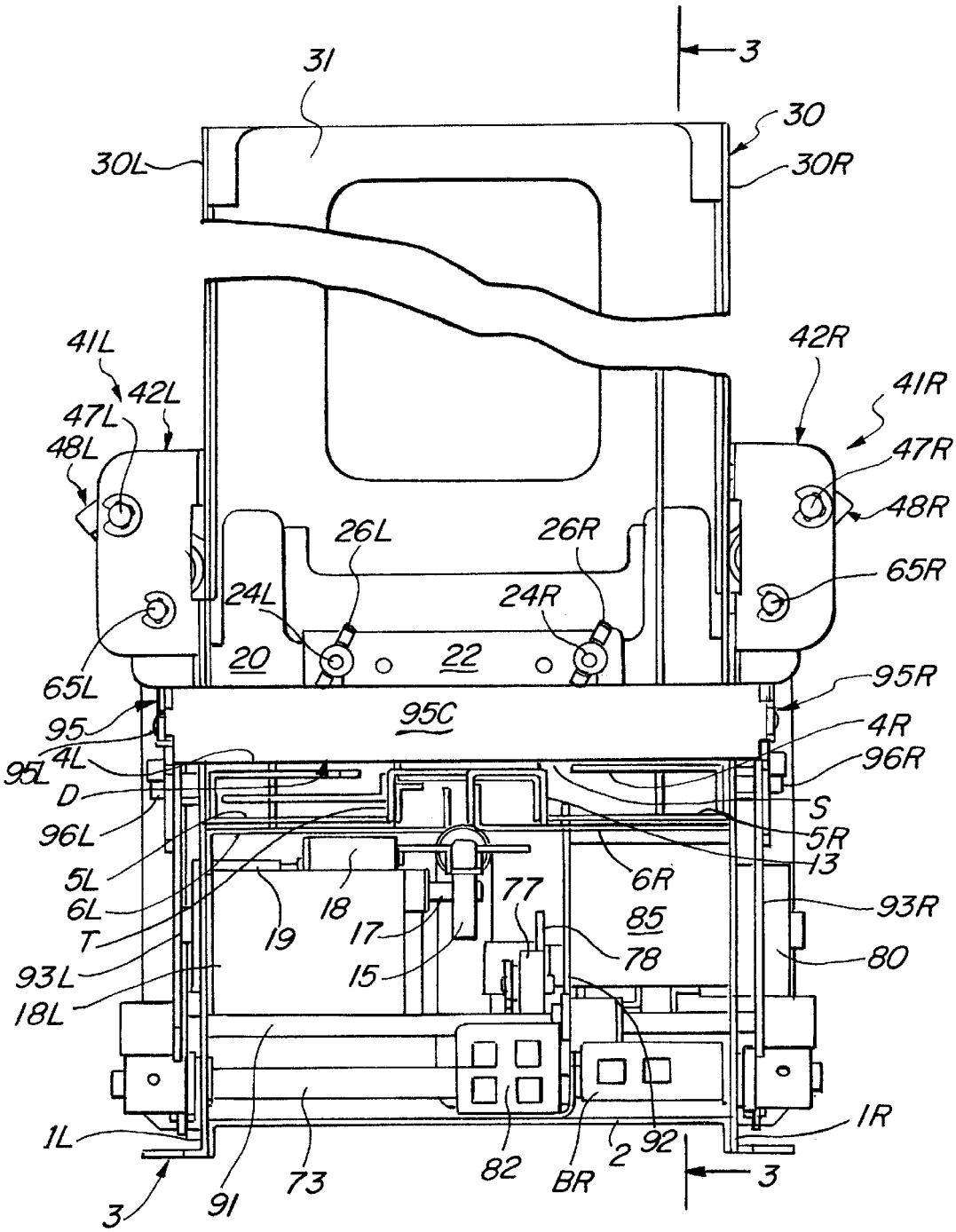
FIG. 2 is a front view of the preferred embodiment of FIG. 1.
Figure 3:
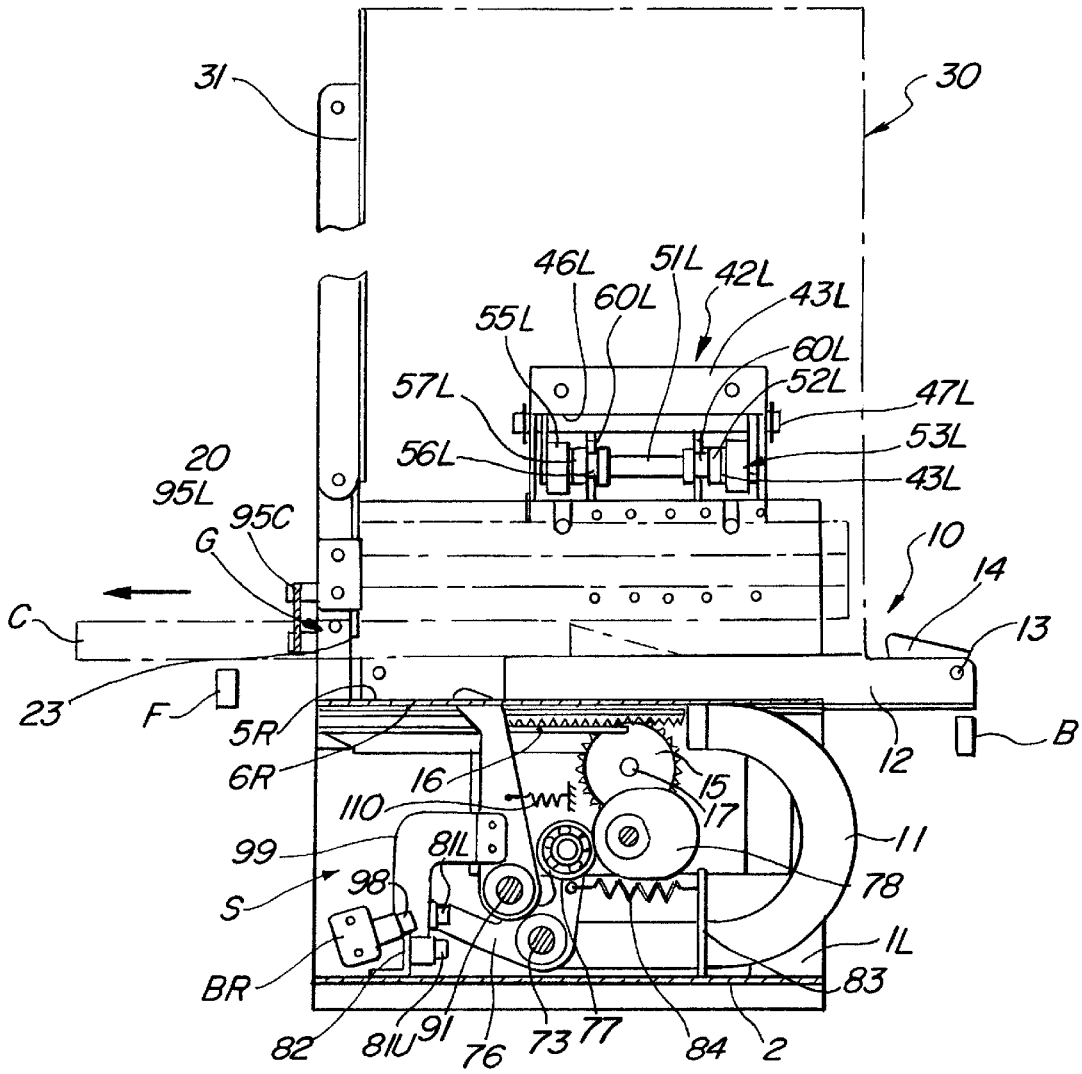
FIG. 3 is a side view in cut away along lines x—x of the preferred embodiment shown in FIG. 2.
Figure 4:
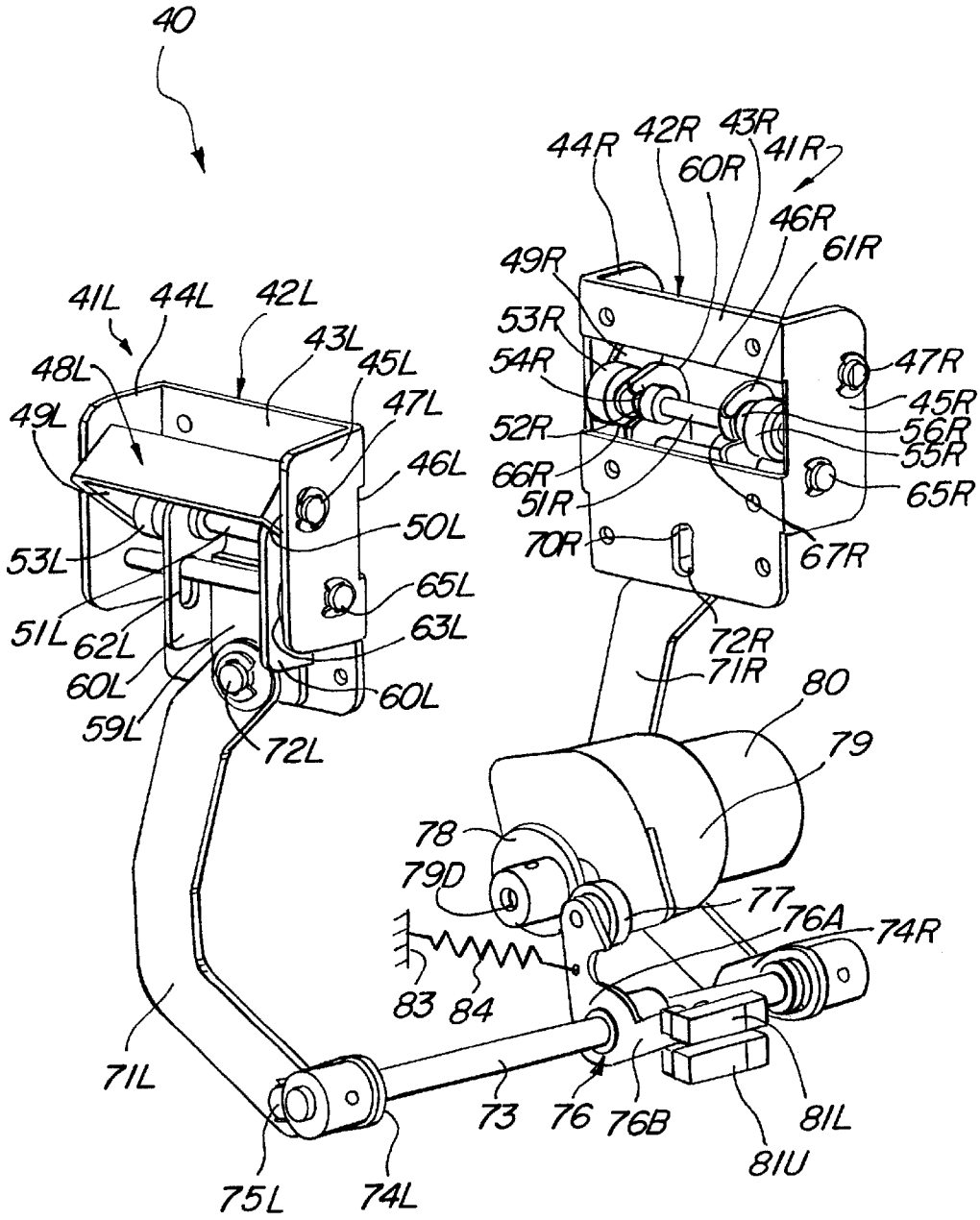
FIG. 4 is an elevated perspective view of a preferred embodiment of a lifting mechanism of the present invention.

A second set of guide plates 6L, 6R, are disposed slightly below the guide plates 5R, 5L and are mounted to their respective side plates 1R, 1L. There is a gap T between the guide plates 5L and 5R, and there is a gap U between the second set of guide plates 6L and 6R. A sliding mechanism 12 is disposed between the guide plates 5L, 5R at gap T, and a rack 16 of the sliding mechanism 12 is located in the gap U between guide plates 6L and 6R. In FIGS. 2 and 3, the sliding mechanism 12 can be seen more clearly. The sliding mechanism 12 includes a pushing mechanism 14 that pivots about pin 13. The pushing mechanism 14 is biased by a spring (not shown) such that pushing mechanism 14 protrudes above the sliding mechanism 12. The rack 16 is formed in the underside of the sliding mechanism 12 and engages a drive gear 15 which causes the sliding mechanism to be directed laterally in the forward and aft directions according to the direction of the drive gear 15.

A driving motor 19 connected to a speed reducer 18 and shaft 17 drive the drive gear 15. Hence, the drive motor 19 is responsible for the control over the sliding mechanism 12 in both the forward and rearward directions. The speed reducer 18 is mounted to the side plate 1L via bracket 18L. A U-shaped pipe 11 mounted to the base plate 2 serves to guide the flexible rack 16 mounted beneath the sliding mechanism 12. A sensor F, shown in FIG. 3, detects when the sliding mechanism 12 advances to its forwardmost position.

The sensor F will transmit a signal to a microprocessor (not shown) for withdrawing the sliding mechanism 12 as discussed more fully below. Similarly, sensor B detects when the sliding mechanism 12 retreats to its furthest aftward position, and sends a signal indicating this condition to the microprocessor. On the front of the machine is a face plate 20 positioned just above the sliding mechanism 12.

The face plate 20 is located immediately in front of the platforms 4L, 4R. The face plate 20 is fixed by bolts in a pair of elongated slots 21L, 21R on the side plates 1L, 1R, respectively. An opening, or gate G, defined by the platforms 4L, 4R and the face plate 20 is sized to permit the particular article to pass through when the pusher mechanism 12 provides the impetus to push the article C through the opening G. The height of the gate G is only slightly larger than the height of the article C.

A return prevention member 23 is provided to prevent the inadvertent withdrawal of the partially protruding article C back into the machine. The return prevention member 23 is secured to the face plate 20 by a fitting strip 22, and partially overlays the gate G from above. The return prevention member 23 is preferably made of a soft and flexible material which will not likely damage the article, such as polyurethane, and includes downward facing projections 23A, 23B, and 23C. The fitting strip 22 is secured to the face plate 20 using wing nuts 26L and 26R secured to bolts 24L and 24R, respectively, which project from the face plate 20 in a forward facing direction.

The fitting strip 22 is then placed over the return prevention member 23 in such a manner as to secure the return prevention member on the face plate 20. The downward facing projections contact the article C as the article is passing through the gate G, and the downward facing projections 23A,B,C are deformed thereby. The downward facing projections contact the article C as it begins to pass through the gate G and acts as a one-way valve that deters the article C from returning to the machine due to the resistance of the downward facing polyurethane projections in contact with the article C. In this manner, the return prevention board 23 prevents the article C from being inadvertently withdrawn back into the machine.

The upper portion 30 of the machine is the storing repository for the articles to be stacked. The upper portion is formed by side walls 30L, 30R and back wall 30B forming a generally rectangular cross section. A removable front panel 31, which may include in the observatory window for selecting or observing the articles, encloses the stored reservoir and leaves an opening along the upper portion 32. Articles may be loaded through the opening 32 into the upper portion 30 with the front panel 31 removed, and the articles can be stacked on the platforms 4L and 4R on the loading mount D.

FIGS. 4–8 illustrate a preferred lifting mechanism of the present invention. A pair of lifting devices 41L and 41R cooperate to form the lifting device 40 of the present invention. Each lifting mechanism is affixed to its respective side walls 30L, 30R. The discussion below will refer primarily to the right hand side lifting mechanism 41R which is symmetric in virtually all respects to the lifting mechanism on the left hand side 41L.

A U-shaped support bracket 42R is mounted to the right side wall 30R. Supporting bracket 42R includes perpendicular flanges 44R and 45R with respect to the base of the bracket 43R. The base 43R of the bracket 42R includes a window 46R through which a lifting mechanism will selectively protrude as provided more fully below. The window 46R coincides with an opening OR on the side wall 30R, the opening OR directly adjacent to the window 46R and provides access to the articles C therein. The position of the opening OR and the window 46R is preferably in a vertical displacement of approximately 4–6 articles C (see FIG. 3) when said articles are stacked on the loading platform D.

Figure 5:
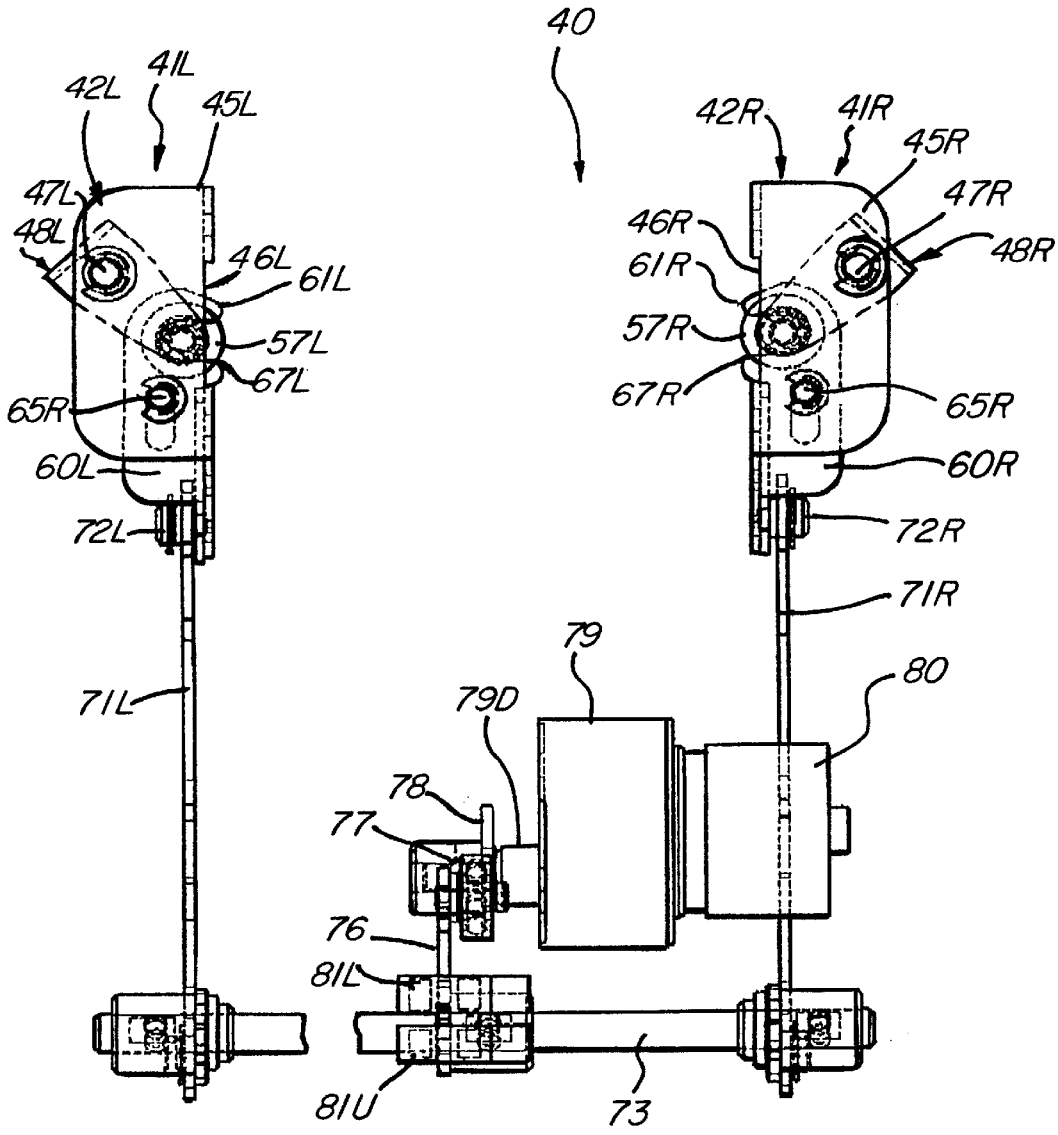
FIG. 5 is a front view of the lifting mechanism of FIG. 4.

A first rod 47R is disposed between the perpendicular flanges 44R and 45R. A lifting lever 48R mounts to the rod 47R and pivots thereabout. The lever comprises a longitudinal component and supporting legs 49R and 50R where supporting legs 49R and 50R are seated on the rod 47R. The lever 48 also includes a second shaft 51R connecting legs 49 and 50 opposite the longitudinal component. The cylinder 54R having a rubber ring 53R in a groove of a guide 52R is located on shaft 51R. Similarly, the cylinder 55R including a rubber ring 57R in the groove of a guide 56R is located on shaft 51R. The rubber rings 53R, 57R project through the opening 46R of the side panel 30R as shown in FIG. 5. Further, it can be seen that if the lifting lever 48 is rotated clockwise in FIG. 5 due to a upward movement of bracket 60R, the subsequent rotation of shaft 51R about rod 47R will cause the shaft and the rubber rings 53R,57R to extend through the window 46R in an upward direction. This condition is described more fully below.

Within the bracket 42R is a slide plate 58R formed of a base 59R and flanges 60R and 61R forming a U-shaped cross section. Side flanges 60R and 61R include elongated slots 62R and 63R where a third shaft 65R is disposed. A claw shaped member defined by open slots 66R and 67R are formed at the upper portion of the side flanges 60R and 61R. Open slots 66R and 67R are elongated in the horizontal direction and open towards the window 46R. The open slot 66R holds the guide groove 52R of the cylinder 55R. Similarly, the open slot 67R holds the guide groove 56R of the cylinder 55R. Accordingly, when the slide plate 58R is displaced in the vertical direction, the lever 48R pivots about the rod 47R causing the cylinder 67R with rubber rings 57R to rotate clockwise in FIG. 5 about rod 47R through the window 46R. As will be explained below, the protrusion of the cylinders 67R and 67L cooperate to lift the article housed in the mounting structure 30 through windows OR and OL.

Figure 6:
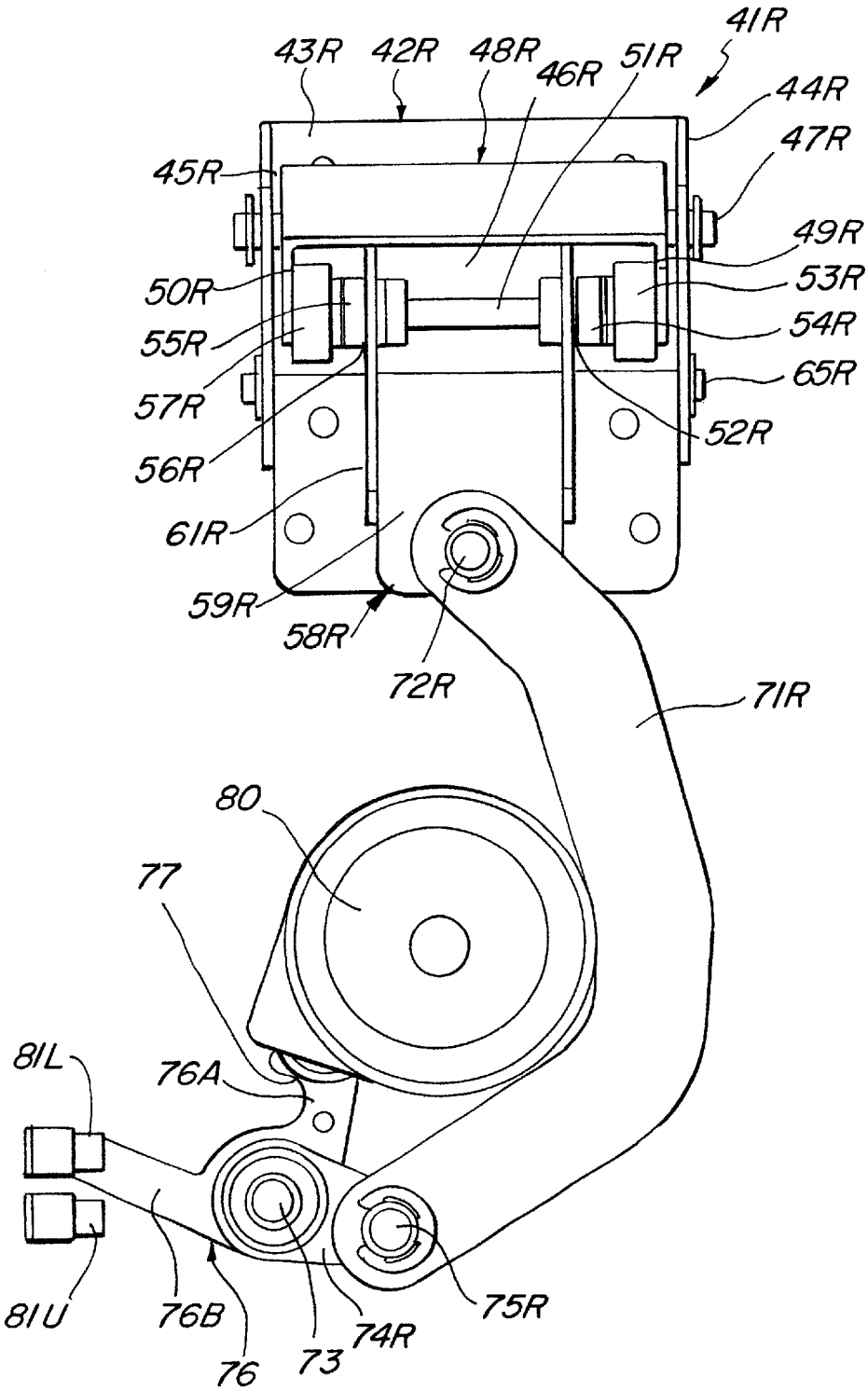
FIG. 6 is a right side view of the lifting mechanism of FIG. 4.

As shown in FIGS. 5 and 6, an elongated slot 70R is located in the bracket 42R below the window 46R. A pin 72R located at the upper portion of link member 71R slides freely in the vertical direction within the elongated slot 70R, but is fixed rigidly to slide plate 58R at base 59R. At the lower end of the link member 71R is a pin 75R which connects the link member 71R with a lever 74R. The lever 74R is rotatably connected to a fixed shaft 73 extending between the side plates 1L and 1R. Also connected to the shaft 73 is a V-shaped lever 76. At one end of the V-shaped lever 76 is a cam follower 77 at the end of arm 76A. The cam follower 77 is biased in contact with the eccentric cam 78 via a spring 84 mounted to a bracket 83. The spring 84 is preferably selected such that the cam follower 77 exerts no force on the eccentric cam 78 when the distance between the cam follower 77 and the center of the cam is at a minimum.

The eccentric cam 78 is fixed on an output shaft 79D of a speed reducer 79. The speed reducer 79 in turn is connected to a drive motor 80. The speed reducer 79 is fixed at the side plate 1R by the bracket 85. Mounted adjacent the arm 76B of the V-shaped lever 76 is a pair of sensors 81L, 81U mounted substantially vertical by a bracket 82 which is secured to the base plate 2. The sensor 81U outputs a lift signal "U" when the V-shaped lever contacts the sensor 81U, and the sensor 81L outputs a release signal "L" when the V-shaped bracket at arm 76B contacts the sensor 81L.

As can be seen in FIGS. 2 and 3, a shaft 91 is mounted horizontally in side plates 1L and 1R. A lever 92 is pivotally mounted on the shaft 91 and rotates in a vertical plane. The length of the lever 92 is selected such that a portion of the lever protrudes above the guide plates 5R immediately preceding the sliding mechanism 12 for a portion of the arc traced by the lever 92. The rotation of the shaft 91 is controlled by a pair of levers 93R and 93L which are mounted on the outside of the side plates 1R, 1L on the shaft 91 (see FIG. 1). The lever 93R has a pin 94R which is captured in a elongated slot 97R on bracket 95R. Brackets 95R, 95L and guard plate 95C cooperate to form a U-shaped formation mounted at side walls 1R, 1L, by shafts 96R and 96L protruding from the outer side walls 1L, 1R.

Element 99 (FIG. 3) is an elbow-shaped bracket connected to the driving lever 92. A sensor 98 adjacent to the element 99 detects the position of the detecting element 95. The driving lever 92 is biased in the clockwise direction as shown in FIG. 3 by the force of a spring 110. A bracket BR is mounted in the side wall 1R and mounts the sensor 98.

Figure 9:
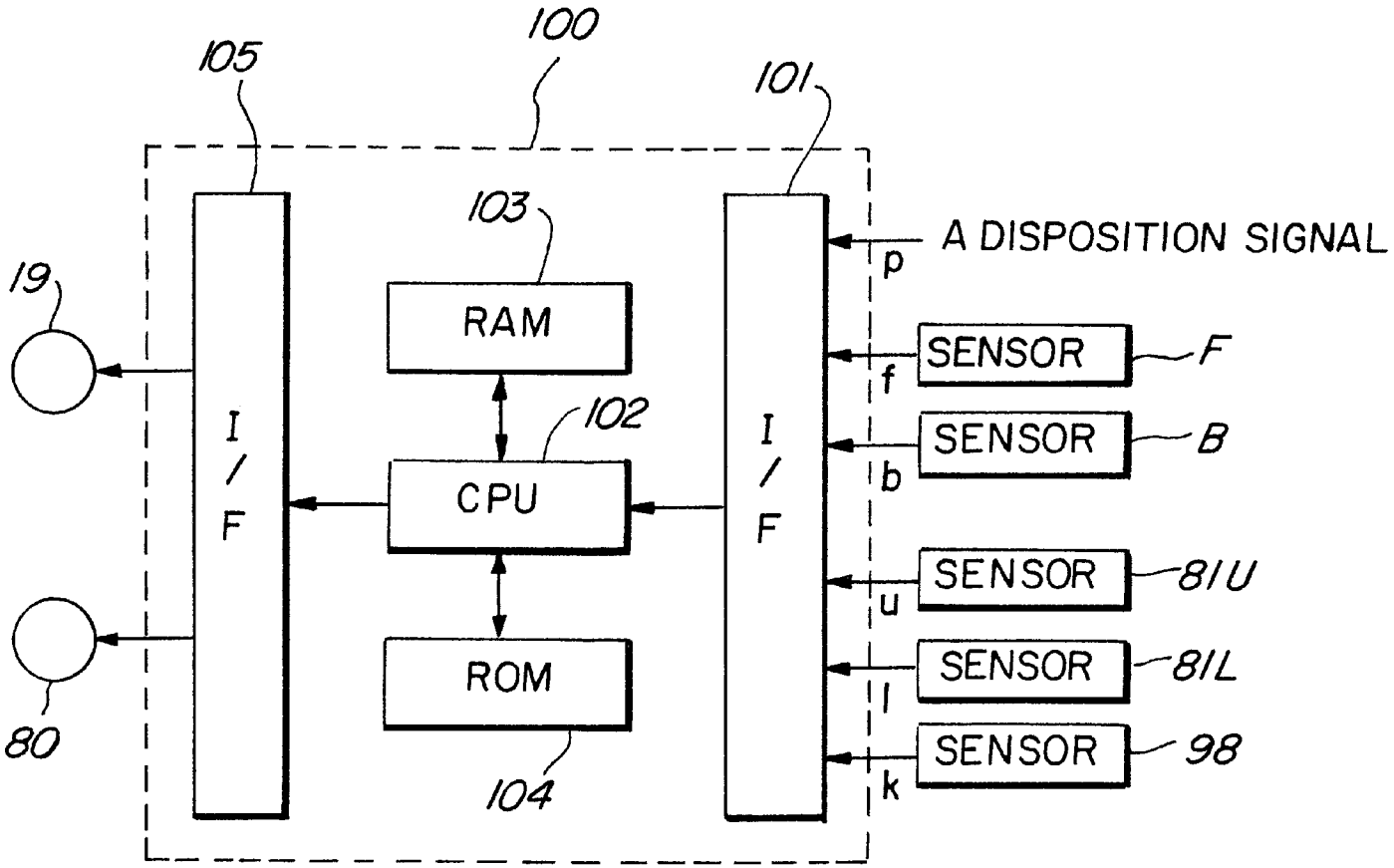
FIG. 9 is a block diagram of a control device of the present invention.

FIG. 9 illustrates a schematic of a control device 100 associated with the present invention. Control device 100 comprises an interface 101 which receives the signals from sensors F, B, 81U, 81L and 98, and the dispense signal P; as well as RAM 103 and ROM 104, and an interface 105 which outputs a rotation and stop signal for the control circuit of the motors 19 and 80. The control device 100 controls the actuating motors 19 and 80 according to the flow chart of the program stored in ROM 104 based on the signals from sensors F, B, 81U, 81L and 98.

The operation of the unit is now explained. In a standby condition, the sliding mechanism 12 resides in its most retracted position (all the way to the right in FIG. 3). The pushing mechanism 14 is rotated outward such that it protrudes from the upper surface of the sliding mechanism 12. The platforms 4L and 4R of the loading mount D support the stack of articles C. The cam follower 77 of the lifting devices 40 is in a position adjacent the narrowest width of the cam radius. In FIG. 6, the lever 74R is rotated in the most clockwise position. Accordingly, the link member 71R is in its lowest vertical condition and the slide plate 58R is also in its lowest vertical position. In the standby condition, the cylinders 54R and 55R are also in its lower most position because the slide plate 58R is in the bottom position. Thus, the lifting lever 48R is in its most vertically rotated position and the rubber rings 53R and 57R on the cylinders 54R and 55R are in a position that retracts the rings from the opening OR on the side of the storage reservoir 33. In this manner, the rubber rings 53R and 57R (as well as the rubber rings 53L and 57L) are not in contact with the article C stored in the reservoir 33. Also, the lever 92 is rotated in its most clockwise condition by the force of the spring 110, and the levers 93L, 93R are also rotated in their most clockwise rotation position as shown generally in FIG. 1. The guard plate 95C is located just in front of the gate G. In this position, the guard plate 95C prevents access to the gate G and serves as a theft deterrent function.

Figure 10:
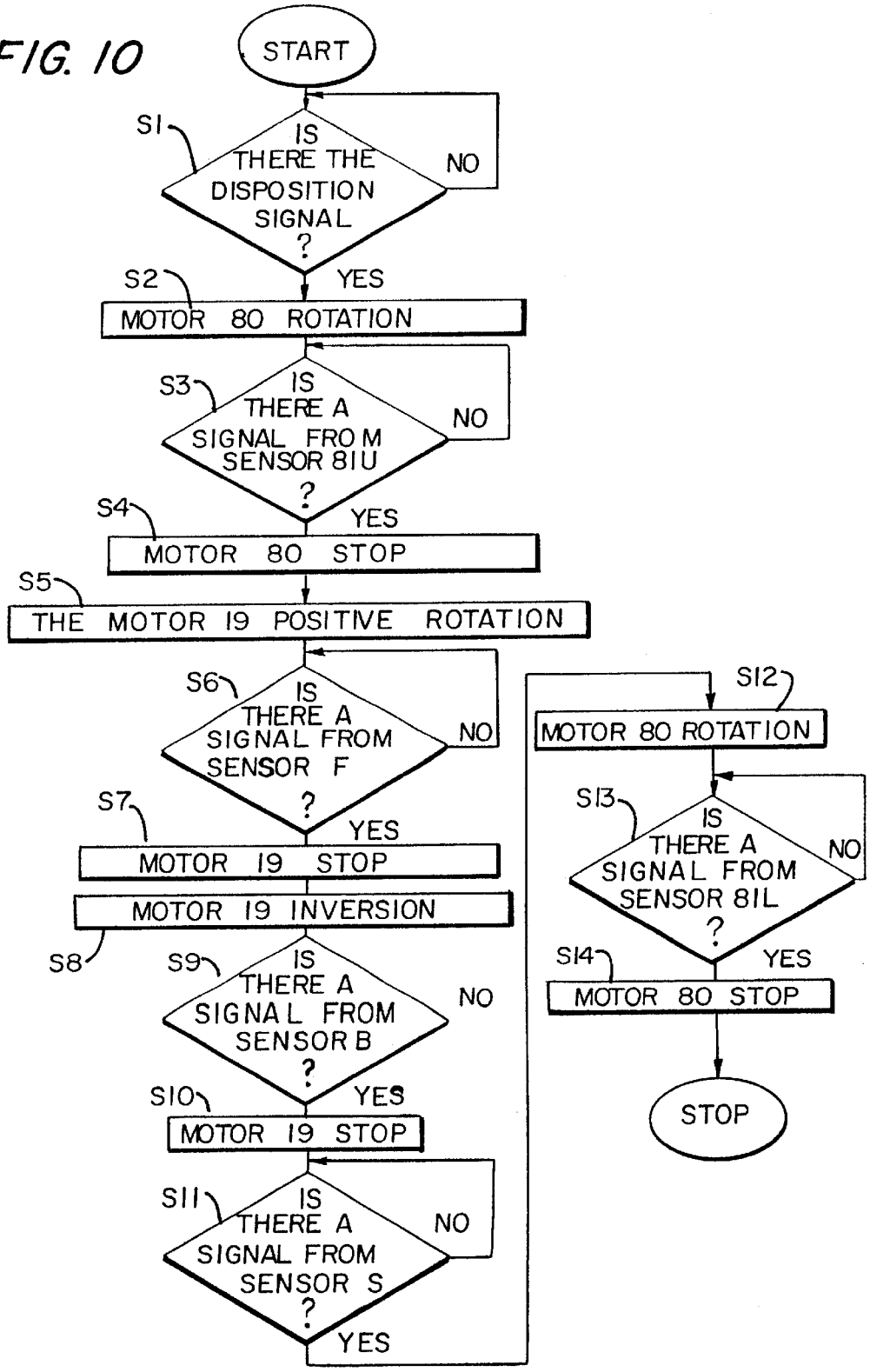
FIG. 10 is a flow chart of the present invention's operation.

The operation of the automatic disbursal of an article C will now be discussed with reference to the flow chart in FIG. 10. In step 1 the machine is in the condition where a disposition signal is received for the automatic disbursal of an article C. Prior to receiving the disposition signal P, the apparatus remains in the standby condition described above. Upon receipt of a disposition signal P, in step 2 the rotation signal of the motor 80 is given through the interface 105. The motor 80 receives the rotation signal and it initiates rotation. By the rotation of the motor 80, the speed reducer 79 and the eccentric cam 78 is rotated.

Figure 7:
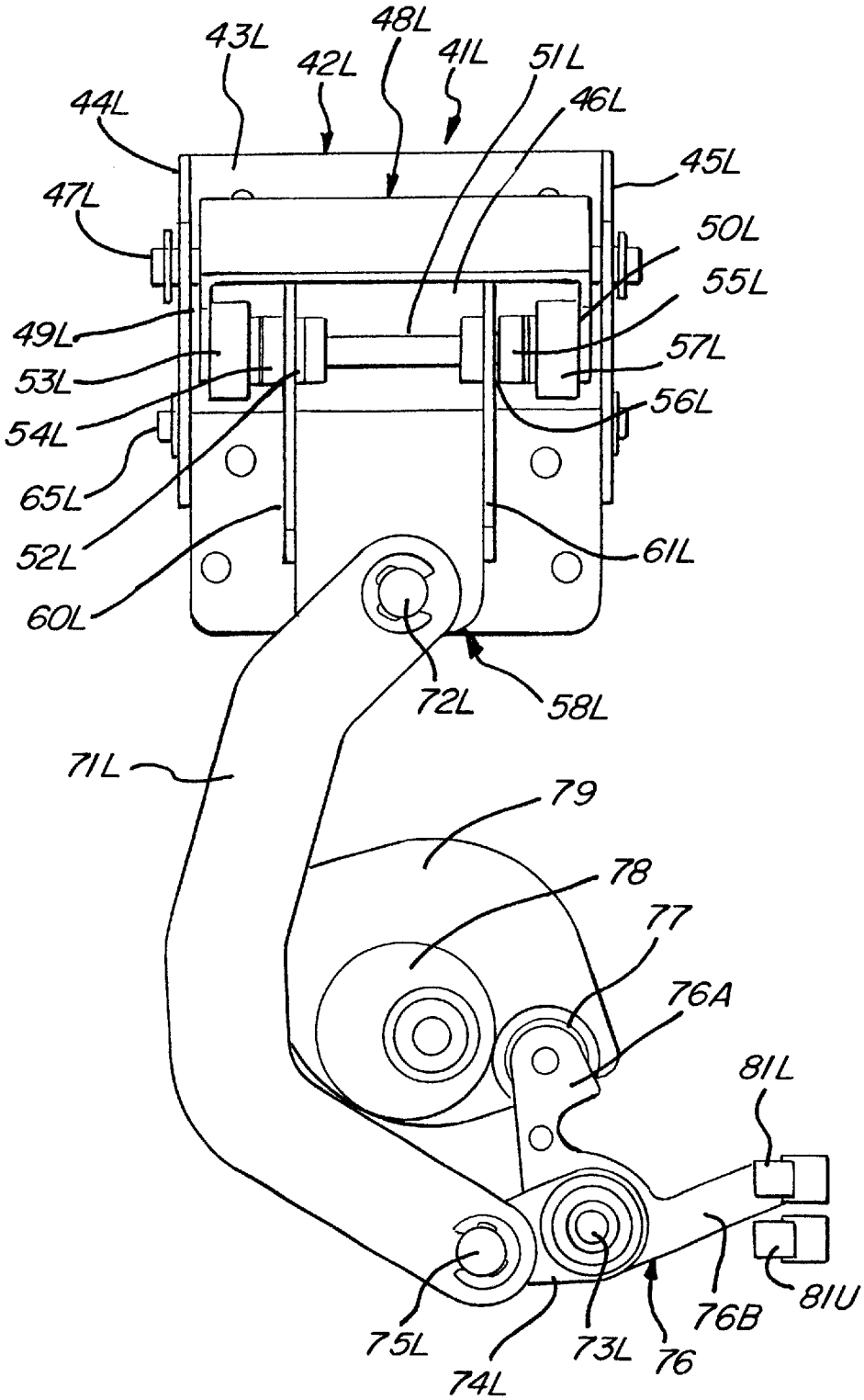
FIG. 7 is a left side view of the lifting mechanism of FIG. 4.
Figure 8:
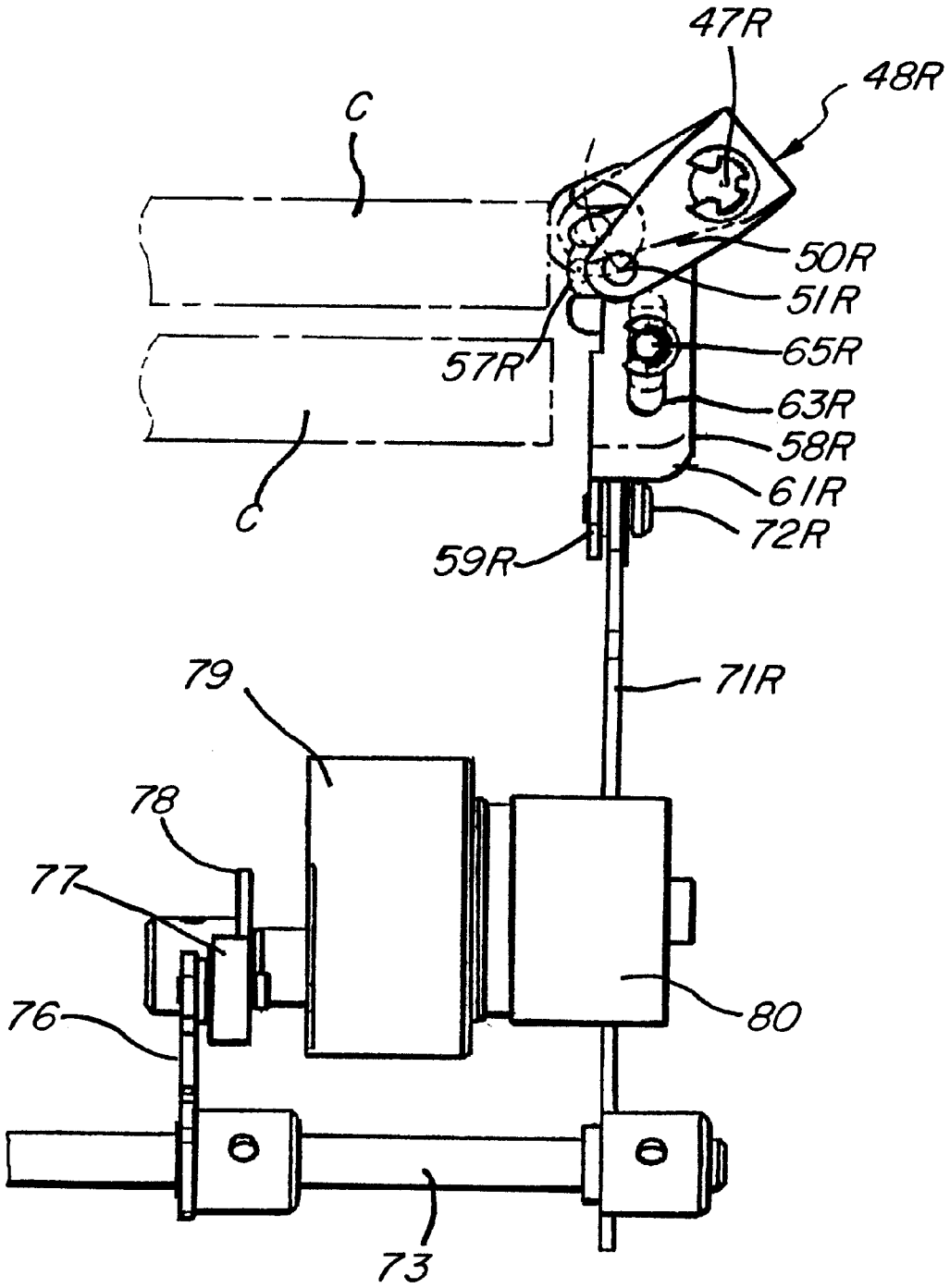
FIG. 8 is a front view of the lifting mechanism of FIG. 4 cooperating with an article C shown partially in phantom.

By the rotation of the eccentric cam 78, the contact with the eccentric cam 78 and the cam follower 77 causes the v-shaped lever 76 to rotate counter-clockwise as shown in FIG. 3. Accordingly, the lever 74R is rotated through the shaft 73 in the counter-clockwise direction. In FIG. 7, the lever 74L rotates in the clockwise direction. The rotation of the respective levers 74R, 74L in turn cause the link members 71R and 71L to be translated upward on pins 75R and 75L. The link member 71R pushes up the slide plate 58R which in turn rotates lever 48R inward towards the machine. The arms 49R and 50R rotate the shaft 51R center about the shaft 47R in FIG. 8 in the clockwise direction. This, in turn, causes the shaft 51R to rotate from a lowest vertical position to a higher position shown in dotted lines on FIG. 8. The rotation of shaft 51R causes the rubber rings 53R and 57R to extend through the opening OR and contact the article C from the right hand side. Simultaneously, a rotation of shaft 51L about shaft 47L causes rubber rings 57L and 53L to protrude through the opening OL on the left hand side of the apparatus and contact the article C from the left hand side. Further rotation of the respective shafts 51R, 51L result in the cooperating rubber rings lifting the article C off of its adjacent article stacked below it. The two cooperating lift mechanisms 41R and 41L lift the retained article C, as well as the stack of articles above the article C, thereby reducing the total weight on the lower most article C to be dispensed.

The sensor 81U detects that the lever 76A of the V-shaped lever 76 has rotated accordingly and the signal U is output. In step 3, the signal U is received. On receipt of the signal U in step 4, the rotation of the motor 80 is stopped. When the motor 80 is stopped, the cooperating lift mechanisms 41R and 41L maintain their condition in the above-referenced state. In step 5, the initiation of the rotation of motor 19 occurs. Rotation of motor 19 causes the drive gear 15 to rotate slowly in the counterclockwise direction as shown in FIG. 3. The sliding mechanism 12 translates from right to left via the rack 16 cooperating with the drive gear 15. This process causes the pushing mechanism 14 to contact the back wall of the lower most article C in the stack and advance the article towards the front of the machine. This is shown with dotted lines on FIG. 3. The pushing mechanism 12 advances the stack of articles C not retained by the cooperating lifting mechanisms 41L, 41R, but the height of the gate G permits only the advancement of the lower most article C through the gate G. The pushing mechanism 12 continues to progress until about one-half of the length of the lowermost article C protrudes through the gate G. The weight on the lowermost article C is significantly reduced by the retention of the majority of the stack by the cooperating lifting devices 41L, 41R. Accordingly, the frictional force between the platforms 4A, 4B and the lower most article C, as well as the frictional force between the lowermost article C and the article immediately above the lowermost article C, is significantly reduced. Therefore, the amount of force needed to eject the lower most article C is reduced.

As the sliding mechanism 12 advances to a most forward position, the lever 92 is rotated as shown in FIG. 3 in the counter-clockwise direction. This rotation also causes levers 93R and 93L to rotate in the counter-clockwise direction through shaft 91. Pins 94R, 94L rotate accordingly in a counter-clockwise arc. The combination of this circular arc motion and the cam grooves 94R, 94L rotate the guard plate 95C about the shafts 96R and 96L in FIGS. 1 and 3, in the clockwise or upward direction. This rotation causes the guard plate 95C to move away from the opening of gate G.

The evacuation of the guard plate allows the article C being pushed by the pushing mechanism 14 to protrude past the guard plate 95C. The sensor 98 further detects the rotation of the linking lever 99 cooperating with the lever 92. The sensor F determines that the pushing mechanism 14 has reached the most advanced position shown in dotted lines on FIG. 3. Step 6 receives the signal from sensor F that the pushing mechanism 14 has reached the most forward position. This leads to step 7 where the rotation of motor 19 is halted. Next, motor 19 is reversed and is driven at step 8. The drive gear 15 rotates in the counter-clockwise direction withdrawing the sliding mechanism 12 at the rack 16. This sequence is continued until the sliding mechanism 12 returns to the position shown in solid lines in FIG. 3. Sensor B detects that the sliding mechanism 12 has returned to its original position and outputs signal B. In step 9, the output of sensor B is received.

In step 10, upon receipt of signal B in step 9, the rotation of motor 19 is stopped. With the slider mechanism 12 advanced to the farthest rearward position, the contact between the lever 92 and the sliding mechanism 12 is discontinued. The release of the lever 92 permits the lever to be rotated by the spring 110 in the clockwise direction. Shafts 96R, 96L rotate in the counter-clockwise direction, which, in turn, rotates the guard plate 95 downward. The article C which has protruded through the gate G stops the rotation of the guard plate 95C. The driving lever 92 thus cannot be rotated to the position shown in the continuous line of FIG. 3. The elbow-shaped member 99 is positioned away from the detection of the sensor 98. In step 11, the receipt of the disposition completion signal K from the sensor 98 is accomplished. The article C can now be withdrawn by a user through the gate G.

The next lowermost article C is located over the platforms 4A, 4B after the lower most article C is withdrawn. The guard plate 95 is no longer supported when the article C is withdrawn from the gate G. The guard plate 95 is therefore rotated further by the motion of the driving lever 92 with the spring 110 in the counterclockwise direction. The guard plate 95 completes the rotation to the position in front of the gate G as shown in the continuous line position of FIG. 3. By this, the elbow-shaped member 99 contacts the sensor 98 which outputs a disposition completion signal K. In step 12 the disposition signal K is received and rotation of motor 80 is initiated. The rotation of motor 80 causes the rotation of the eccentric cam 78 with the cam follower 77 to return to the original position. This causes the shaft 73, the lever 74, the pin 72R, and the link 71R to be returned to the lower most position. The lever 76 is rotated by the spring 84 as shown in FIG. 3 to the clockwise most position. As for the lift mechanism 41R, the slide plate 58R is returned to the lower most position by the action of the link member 71R.

In step 13, the signal from sensor 81L is received. If the signal L is received, step 14 stops the motor 80 and the machine has returned to the standby condition prior to step 1. This condition is maintained until the disposition signal P is received and the procedure is repeated as outlined above.

There can be many alterations to the above discussed embodiments without deviating from the present invention. For example, a set of rollers or a rotating belt can be used to deliver the articles to the loading station D instead of platforms 4A,B. Similarly, a forklift apparatus can be substituted for the lifting mechanism just discussed to lift a portion of the stack of articles by inserting a fork into the stack. In this embodiment, it is not necessary to have a complimentary lifting component on both sides of the machine since a forklift can achieve the objective from a single side. Finally, the dispensing of the article may be sensed by an optical sensor to determine the completion of the operation and initiate the return to standby 10 condition. Those skilled in the art will appreciate that additional various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A machine for automatically dispensing an article from a stack of articles comprising:

a loading platform for moving the stack of articles to a dispensing station;

a sliding mechanism for laterally discharging a lowermost article from a stack of articles;

a lifting mechanism for lifting a portion of the stack of articles above the lowermost article, the lifting mechanism includes a pair of lifting members to lift a portion of the stack of articles from opposite sides of the stack of articles, the pair of lifting members each include a plurality of linkages and each lifting member is driven by a common source, the common source includes a cam which is located under the articles and is rotated by a drive motor;

a pushing mechanism pivotally connected to the sliding mechanism for pushing a bottom article from back of the dispensing station to the front of the dispensing station;

a gate disposed at the front of the dispensing station and sized to permit only one article to pass through at a time, wherein the pair of lifting members on opposed sides of the machine are configured for raising a portion of the stack of articles prior to the operation of the pushing mechanism;

a control system for enabling the sliding mechanism, lifting mechanism and pushing mechanism; and a plurality of sensors for sensing the progress of the operation to dispense the article from the machine automatically, the plurality of sensors are operatively connected to the control system.

2. The machine for automatically dispensing an article from a stack of articles of claim 1 further comprising at least one sensor from the plurality of sensors for sensing that an article has been automatically dispensed and that outputs a signal, and wherein the control system receives the signal from at least one sensor and initiate steps to return the machine to a standby condition.

3. The machine for automatically dispensing an article of claim 1 including a storage repository for storing the stack of articles, the storage repository includes a pair of windows on opposite sides, and wherein the lifting members are external to the storage repository except for projections which lift the portion of the stack of articles through said windows.

4. The machine for automatically dispensing an article of claim 1, further comprising a storage volume used for storing the stack of articles, the storage volume including a pair of windows on opposite sides, and wherein the lifting members are external to the storage volume except for projections which lift the portion of the stack of articles through said windows.

* * * * *